US006743114B2

(12) United States Patent
Best

(10) Patent No.: US 6,743,114 B2
(45) Date of Patent: Jun. 1, 2004

(54) SET OF GOLF CLUB IRONS

(75) Inventor: Christopher B. Best, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/440,710

(22) Filed: May 19, 2003

(65) Prior Publication Data

US 2003/0203763 A1 Oct. 30, 2003

Related U.S. Application Data

(62) Division of application No. 10/132,610, filed on Apr. 25, 2002.

(51) Int. Cl.[7] ..... A63B 53/04

(52) U.S. Cl. ..... 473/291; 473/332; 473/342; 473/350

(58) Field of Search ..... 473/336, 337, 473/350, 332, 342, 324, 291, 349

(56) References Cited

U.S. PATENT DOCUMENTS

| | | | | |
|---|---|---|---|---|
| 4,848,747 A | | 7/1989 | Fujimura et al. | 273/77 A |
| 4,884,812 A | | 12/1989 | Nagasaki et a. | 273/167 H |
| 5,064,197 A | | 11/1991 | Eddy | 273/167 H |
| 5,290,036 A | | 3/1994 | Fenton et al. | 273/167 R |
| 5,299,807 A | | 4/1994 | Hutin | 273/173 |
| 5,332,214 A | | 7/1994 | Tucker, Sr. | 273/78 |
| 5,398,929 A | | 3/1995 | Kitaichi | 273/78 |
| 5,405,137 A | | 4/1995 | Vincent et al. | 273/173 |
| 5,407,202 A | * | 4/1995 | Igarashi | 473/342 |
| 5,425,535 A | | 6/1995 | Gee | 273/78 |
| 5,431,396 A | | 7/1995 | Shieh | 273/78 |
| 5,447,311 A | | 9/1995 | Viollaz et al. | 273/173 |
| 5,485,997 A | | 1/1996 | Schmidt et al. | 273/78 |
| 5,529,543 A | | 6/1996 | Beaumont, Sr. | 473/290 |
| 5,540,436 A | | 7/1996 | Boone | 473/350 |
| 5,593,356 A | | 1/1997 | Takeda | 473/335 |
| 5,707,302 A | | 1/1998 | Leon et al. | 473/324 |
| 5,766,092 A | | 6/1998 | Mimeur et al. | 473/329 |
| 5,775,049 A | | 7/1998 | Fricke | 52/720.1 |
| 5,820,348 A | | 10/1998 | Fricke | 416/248 |
| 5,823,887 A | | 10/1998 | Mikame et al. | 473/290 |
| 5,924,261 A | | 7/1999 | Fricke | 52/720.1 |
| 5,924,939 A | | 7/1999 | Grace et al. | 473/324 |
| 5,944,619 A | * | 8/1999 | Cameron | 473/332 |
| 5,967,903 A | | 10/1999 | Cheng | 473/342 |
| 6,042,486 A | | 3/2000 | Gallagher | 473/329 |
| 6,045,456 A | | 4/2000 | Best et al. | 473/291 |
| 6,159,109 A | | 12/2000 | Langslet | 473/332 |
| 6,200,229 B1 | | 3/2001 | Grace et al. | 473/324 |
| 6,210,290 B1 | | 4/2001 | Erickson et al. | 473/345 |
| 6,224,341 B1 | | 5/2001 | Fricke | 416/248 |
| 6,237,302 B1 | | 5/2001 | Fricke | 52/720.1 |
| 6,244,972 B1 | | 6/2001 | Drossos | 473/324 |
| 6,290,607 B1 | | 9/2001 | Gilbert et al. | 473/291 |
| 6,334,818 B1 | | 1/2002 | Cameron et al. | 473/332 |
| 6,638,183 B2 | * | 10/2003 | Takeda | 473/335 |

* cited by examiner

*Primary Examiner*—Stephen Blau
(74) *Attorney, Agent, or Firm*—D. Michael Burns

(57) ABSTRACT

A set of golf club irons with improved vibration damping and weight distribution, each golf club comprising a shaft and a head comprising a body portion having a front portion and a back portion, wherein the body portion defines an upper aperture and a lower aperture extending through the body portion communicating with the front portion and the back portion.

8 Claims, 6 Drawing Sheets

SET OF GOLF CLUB IRONS

CROSS REFERENCE TO RELATED APPLICATIONS

This application is a divisional of co-pending U.S. application Ser. No. 10/132,610 which was filed Apr. 25, 2002 and is incorporated herein in its entirety by express reference thereto.

FIELD OF THE INVENTION

The present invention generally relates to A set of golf club irons and, more particularly, to a golf club having a head with a combination of improved perimeter weighting characteristics, vibration damping characteristics and increased striking face surface area.

BACKGROUND OF THE INVENTION

The individual golf club heads in a set typically increase progressively in strike face surface area and weight as the clubs progress from the long irons to the short irons. Therefore, the club heads of the long irons have a smaller strike face surface area than the short irons and are typically more difficult for the average golfer to hit consistently well. For conventional club heads, this arises at least in part due to the smaller sweet spot of the corresponding smaller strike face.

To help the average golfer consistently hit the sweet spot of a club head, many golf clubs are available having heads with so-called cavity back designs with increased perimeter weighting. Another trend has been to simply increase the overall size of the club heads, especially in the long irons. Each of these features will increase the size of the sweet spot and therefore make it more likely that a shot hit slightly off the center of gravity of the club head still makes contact with the sweet spot and flies farther and straighter as a result. One challenge for the golf club designer when maximizing the size of the club head concerns maintaining a desirable and effective overall weight of the golf club. For example, if the club head of a three iron is increased in size and weight, the club may become difficult for the average golfer to properly swing.

In recent years, the importance of acoustics and vibration characteristics of golf clubs has come to the fore, because both vibration and sound are determinative in the "feel" of clubs due to the direct sensation of touch and the psycho-acoustic feedback associated with the sound. Most golfers prefer that golf clubs minimize levels of shock, vibration, and airborne noise. Shock and vibration are particularly important in determining performance and tactile sensation, while vibration and airborne noise are critical for impact and psycho-acoustic feedback to the golfer. For the average golfer, a significant sting (structure-borne vibration) on the hands frequently results from an off center (away from the "sweet spot") impact of the club head with the golf ball. Various types of vibration damping and/or acoustic attenuating inserts have been incorporated into club heads to absorb these impact vibrations and audible sounds. However, there is still a need for improvements in weight redistribution as well as vibration damping and/or acoustic attenuation in golf club heads, and especially in iron type club heads.

SUMMARY OF THE INVENTION

The present invention is directed to a set of iron golf clubs with improved vibration damping and/or acoustic attenuation, as well as weight distribution. Each golf club comprises a shaft and a club head. The body portion of the club head has a front cavity in its front portion and a back cavity in its back portion. Two apertures, one upper and one lower, extend laterally across a substantial upper portion and a substantial lower portion of the body portion, respectively. The apertures also extend front-to-back through the body portion communicating with the front and back cavities. The front cavity serves to hold a strike face insert that makes direct contact with golf balls during play. Preferably, the strike face insert has a strength-to-weight ratio greater than that of the body portion. Optionally, a third cavity is disposed within the front cavity below the upper aperture. The third cavity also extends laterally across a substantial lower portion of the body portion, encompassing a recessed rim that surrounds an entire front portion of the lower aperture. The upper aperture, the lower aperture and the third cavity all serve in part for eliminating material and weight generally from central portions of the club head.

In one embodiment of the invention, a vibration damping and/or acoustic attenuating member occupies essentially the entire lower aperture and a portion of the back cavity. Alternatively, the vibration damping and/or acoustic attenuating member is flanged between the strike face insert and the recessed rim, thereby filling the entire third cavity, the entire lower aperture and a portion of the back cavity. The vibration damping and/or acoustic attenuating member preferably has a shear modulus of at least about 1 Mpa, more preferably at least about 2 MPa, and a loss factor of at least about 0.05, more preferably at least about 0.1, over a temperature range of from about 10° C. to about 40° C. and a frequency range of from about 50 Hz to about 5000 Hz, over a temperature range of from about 10° C. to about 40° C. and a frequency range of from about 50 Hz to about 5000 Hz.

Suitable materials to form the vibration damping and/or acoustic attenuating member include without limitation viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; air bladders; liquid bladders; acoustic absorbing materials; Helmholtz resonators; and mixtures thereof. Alternatively, the vibration damping material may be a low-density granular material including perlite; vermiculite; polyethylene beads; glass microspheres; expanded polystyrene; nylon flock; ceramics; polymeric elastomers; rubbers; dendritic particles; or a mixture thereof.

In another embodiment of the invention, the vibration damping and/or acoustic attenuating member may comprise a plurality of layers and a plurality of materials.

In an alternative embodiment of the invention, the vibration damping and/or acoustic attenuating member further contains a weight member that has a specific gravity greater than that of the body portion.

In a further embodiment, an indicia is scribed on a back surface of the vibration damping and/or acoustic attenuating member, so that it is visibly displayed in the back cavity.

In a particular embodiment of the present invention, a golf club of the iron type with improved vibration damping and weight distribution comprises a shaft and a head having a body. The body comprises a back cavity, a front cavity containing a strike face insert, and third cavity within the front cavity. The strike face insert has a strength-to-weight ratio greater than that of the body. An upper aperture is disposed front-to-back through the body connecting the front and back cavities and adjacent to the strike face insert. A lower aperture is disposed front-to-back through the body connecting the third and back cavities. A vibration damping and/or acoustic attenuating member is disposed immediately adjacent to a rear surface of the strike face insert, occupying the entire third cavity, the entire lower aperture and a portion of the back cavity.

The present invention is also directed to a set of golf clubs comprising a plurality of clubs, each having a club head and a shaft that is shorter in length than the shaft of a preceding club in the set. Each club head of the plurality of clubs comprises a front portion having a front cavity and a back portion having a back cavity. The front cavity has a third cavity formed within. The back cavity connects with the front cavity through an upper aperture, and it connects with the third cavity through a lower aperture. A strike face insert is attached within the front cavity.

In one embodiment, the strike face insert is progressively larger for at least some clubs in the set.

In another embodiment, each of the plurality of club heads has a vibration dampening and/or acoustic attenuating member occupying the entire third cavity, the entire lower aperture and a portion of the back cavity. Optionally, the vibration damping and/or acoustic attenuating member comprises a plurality of layers and a plurality of materials.

In a further embodiment of the invention, the vertical position of a center of gravity of the club head progressively elevates for at least some clubs in the set. This may be achieved by progressively decreasing the vertical positions of the upper aperture, the lower aperture and/or the third cavity for at least some clubs in the set.

In order to increase the club head weights from longer irons to shorter irons, the volume of material of a shelf surrounding the upper aperture and the volume of material of a rim surrounding the lower aperture may progressively increase for at least some clubs in the set. Alternatively or in combination, the volumes of the upper aperture, the lower aperture, and/or the third cavity may progressively decrease for at least some clubs in the set.

The increasing trend in weight within the set of clubs may also be achieved by progressively increasing the weight of the vibration damping and/or acoustic attenuating member for at least some clubs in the set, either by using materials of increasing density, or by increasing the volume of the member.

In another embodiment of the present invention, the vibration damping and/or acoustic attenuating member further contains a weight member. With this embodiment, trends of increasing weights and increasing vertical positions of centers of gravity may be realized by progressively increasing the volume, the density and/or the vertical position of the weight member for at least some clubs in the set.

DETAILED DESCRIPTION OF THE INVENTION

Figure 1:
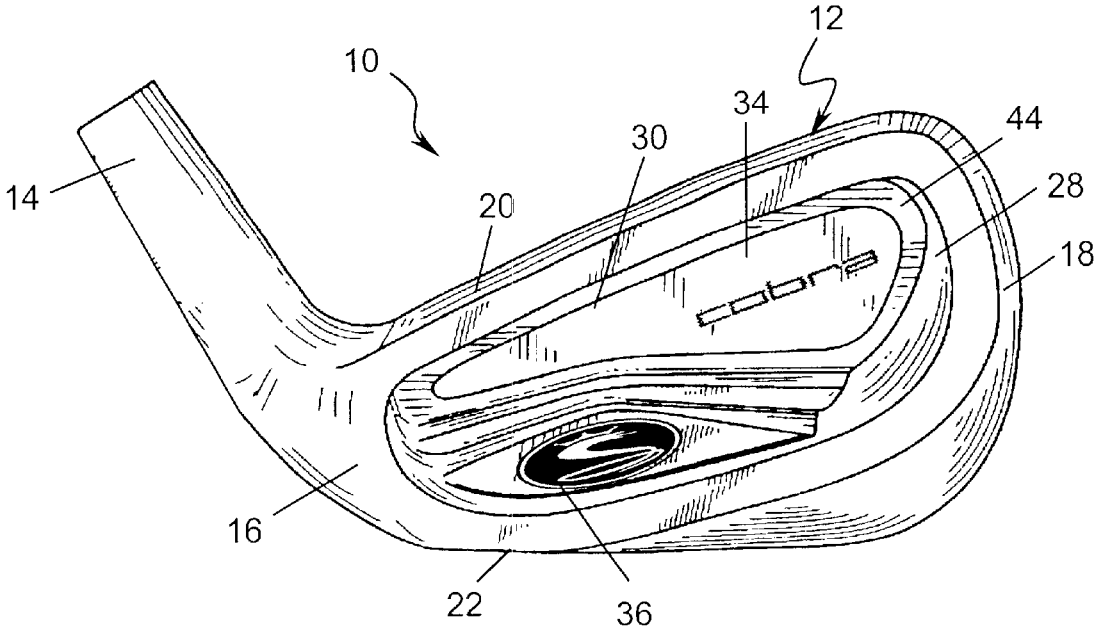
FIG. 1 is a rear perspective view of an iron type golf club head of the present invention showing a strike face insert affixed to the club head, abutting against an upper aperture.
Figure 2:
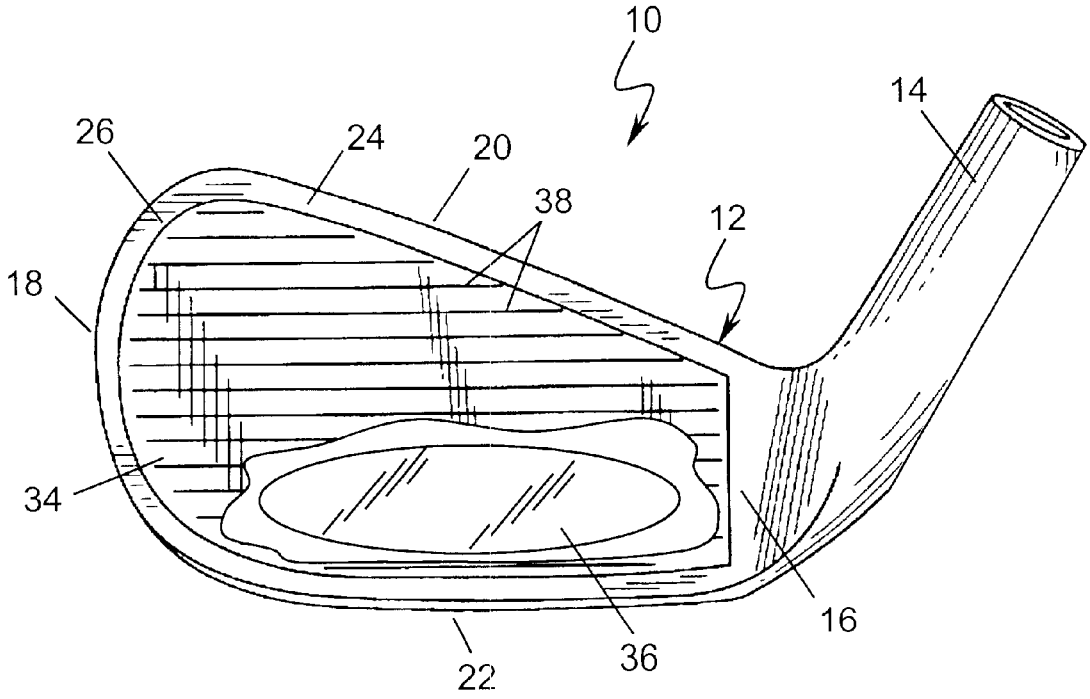
FIG. 2 is a front elevated view of the club head showing the strike face insert, which is partially fragmented to show a vibration damping and/or acoustic attenuating insert.
Figure 3:
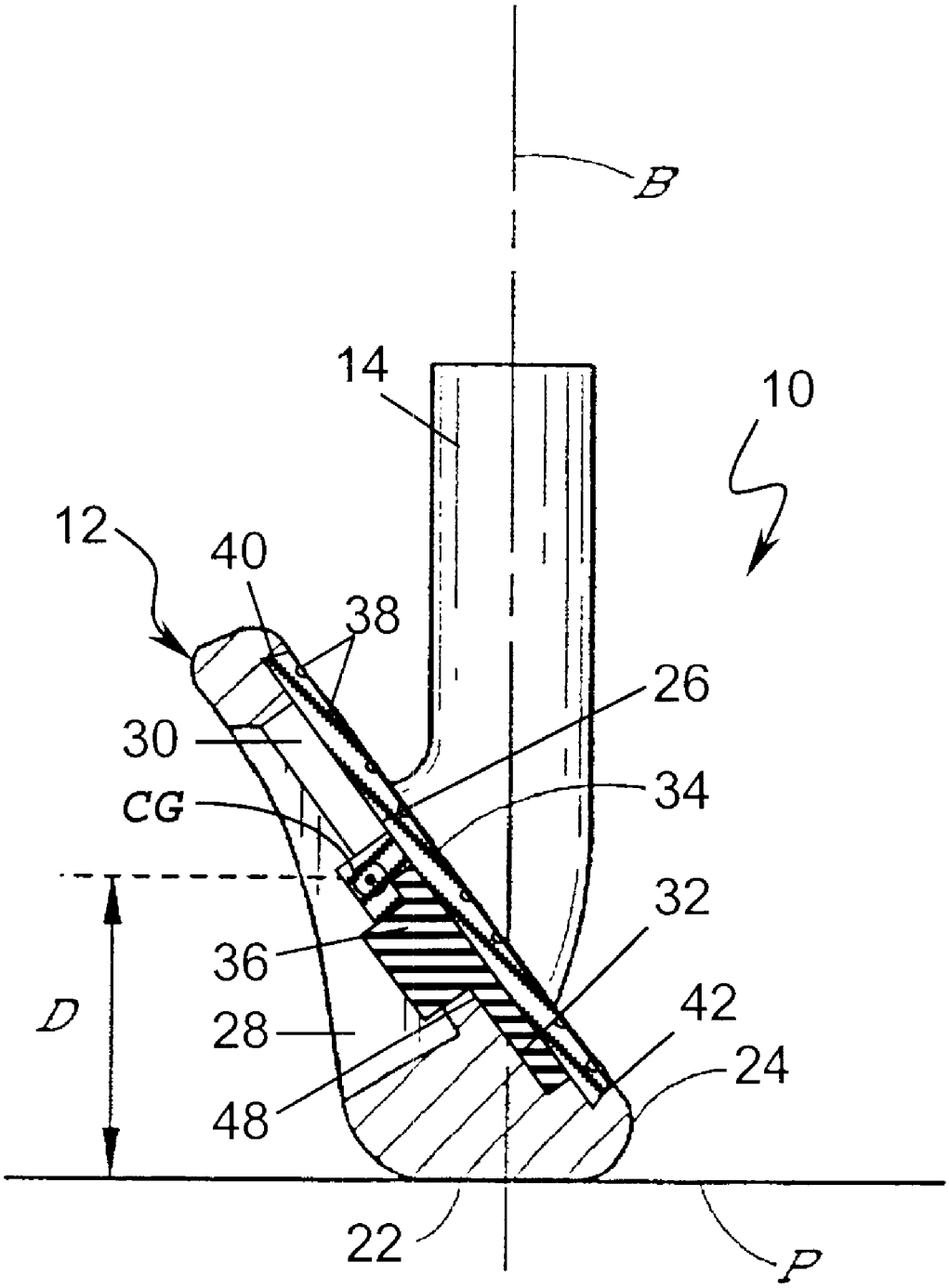
FIG. 3 is a cross sectional view of the club head showing the strike face insert, the upper aperture, the rear cavity, a lower aperture within a captive cavity, and the vibration damping and/or acoustic attenuating insert in place, occupying the captive cavity and the lower aperture.
Figure 4:
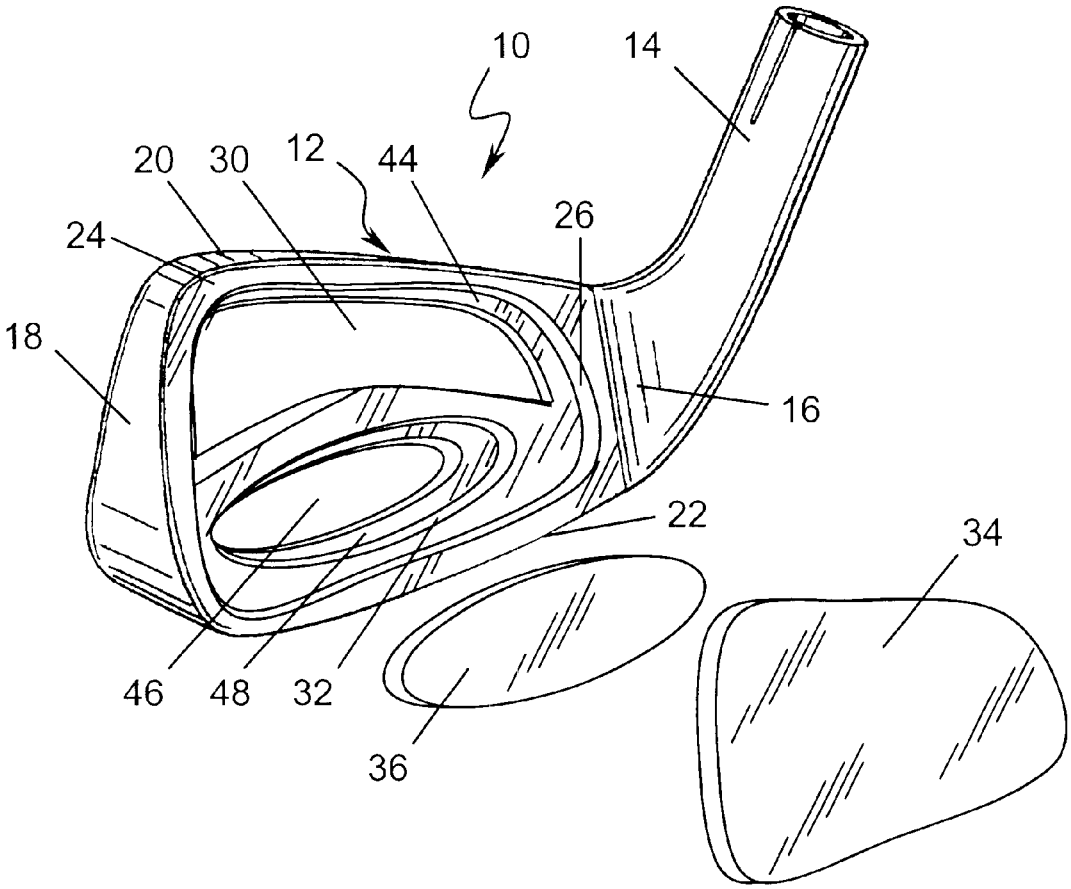
FIG. 4 is a front exploded perspective view of a three piece club head of the present invention showing the upper and lower apertures, the vibration damping and/or acoustic attenuating insert and the strike face insert.
Figure 5:
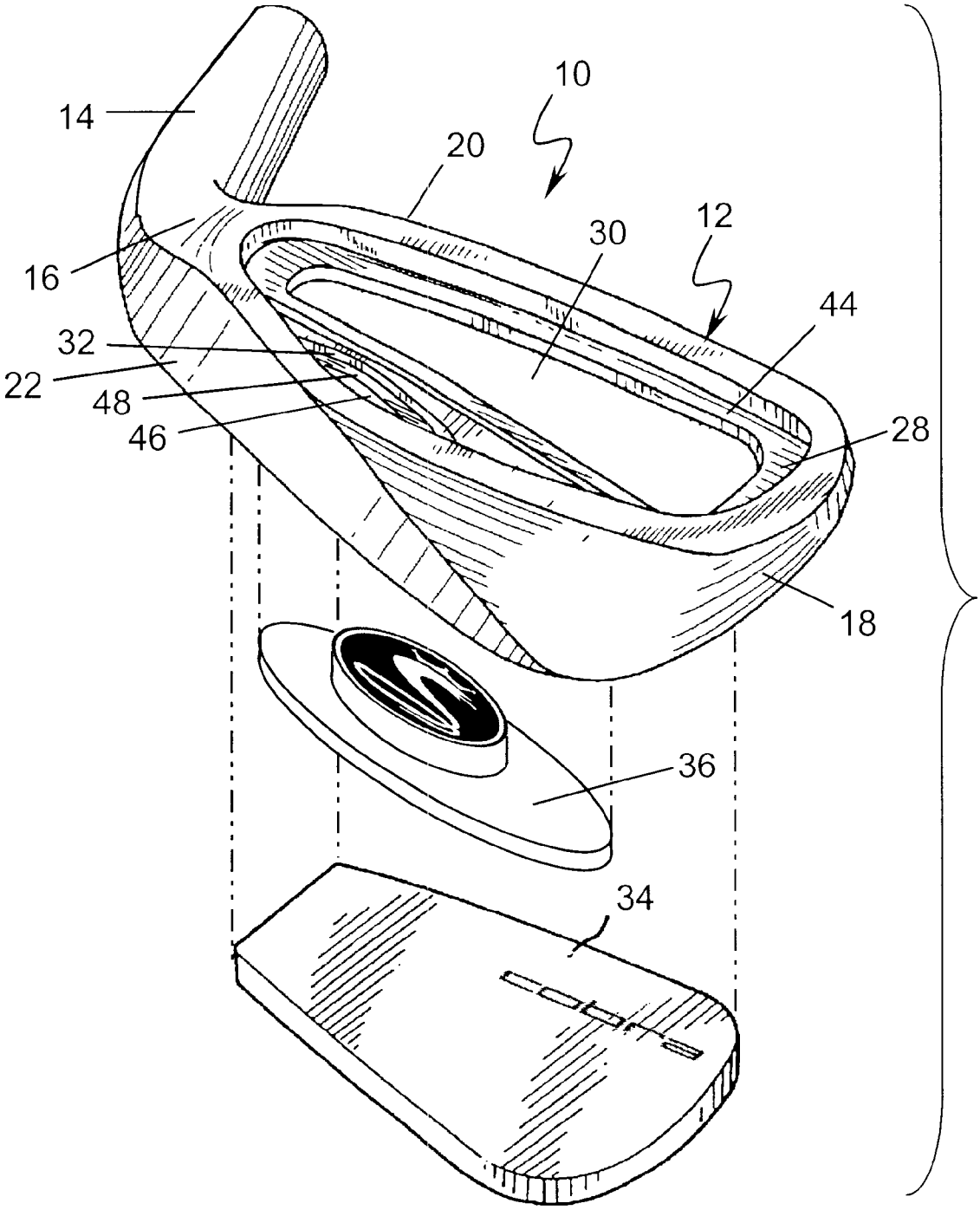
FIG. 5 is a rear exploded perspective view of the same three-piece club head in FIG. 4.

Referring first to FIG. 1, club head 10 constructed in accordance with a preferred embodiment of this invention is shown and includes generally club head body portion 12 having hosel portion 14, heel portion 16, toe portion 18, upper edge 20 and lower edge 22. As shown in FIGS. 2, 3 and 4, club head body portion 12 includes front side 24 with strike face insert cavity 26 contained therein which receives strike face insert 34. Club head body portion 12 also includes rear cavity 28. Upper aperture 30 and lower aperture 46 both extend laterally across body portion 12 and front-to-back through body portion 12, communicating with strike face insert cavity 26 and rear cavity 28, as depicted in FIGS. 3, 4 and 5. Captive insert cavity 32, as shown in FIGS. 3 and 4, extends laterally across substantially the lower front portion of strike face insert cavity 26, and encompasses the front portion of lower aperture 46. Shown best in FIGS. 4 and 5, shelf 44 surrounds upper aperture 30, while recessed rim 48 encircles lower aperture 46. Recessed rim 48 may be continuous or discontinuous.

Captive insert cavity 32 and lower aperture 46 together preferably serve to snuggly receive vibration damping and/or acoustic attenuating ("VD-AA") insert 36, Specifically, VD-AA insert 36 is securely and tightly flanged between recessed rim 48 and strike face insert 34, as illustrated in FIG. 3. VD-AA insert 36 dissipates the vibration energy via mechanisms such as non-linear hysteresis of deformation, intrinsic absorption and friction by transforming it into low-grade thermal energy (heat), effectively minimizing resonance and propagation of vibrations, as well as reducing acoustic noises.

Captive insert cavity 32 also serves as a further means of redistributing weight to the perimeter portions, i.e., hosel 14, heel 16, toe 18, upper edge 20 or lower edge 22 of club head body 12. By reducing the sides of captive insert cavity 32 and lower aperture 46 close to one specific portion and enlarging the sides close to other portions, the club head weight is redistributed towards that specific portion. For this purpose, captive insert cavity 32 may be left void of any material.

Effectiveness of VD-AA insert 36 is highly dependent on temperature and frequency. Preferably, materials for VD-AA insert 36 in accordance to the present invention provide significant VD-AA effects over a broad range of temperature and frequency. Shear modulus and loss factor are two parameters commonly used to partially define the damping performance of VD-AA materials. Preferably, materials that form VD-AA insert 36 have a shear modulus of at least about 1 MPa and a loss factor of at least about 0.05 over a temperature range of from about 10° C. to about 40° C. and a frequency range of from about 50 Hz to about 5000 Hz. More preferably, materials for VD-AA insert 36 have a shear modulus of at lest about 2 MPa and a loss factor of at least about 0.1. Most preferably, the loss factor is at least about 0.2. Common methods for measuring the shear modulus and the loss factor include logarithmic decrement method and half-power bandwidth method. Standard test methods for the shear modulus and the loss factor include ASTM E756-98 titled "Standard Test Method for Measuring Vibration-Damping Properties of Materials" and ASTM E1876-00 titled "Standard Test Method for Dynamic Young's Modulus, Shear Modulus, and Poisson's Ratio by Impulse Excitation of Vibration." VD-AA insert 36 further preferably provide a reduction in vibration and/or noise level to the club head by at least about 1 dB; more preferably by at least about 5 dB; most preferably by at least about 10 dB.

Suitable materials for VD-AA insert 36 in accordance with the present invention includes without limitation viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; air bladders; liquid bladders; and mixtures thereof. The metallized polyesters and acrylics preferably comprise aluminum as the metal. Piezoelectric ceramics particularly allow for specific vibration frequencies to be targeted and selectively damped electronically. Commercially available VD-AA materials applicable in the present invention include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, and Legetolex™ from Piqua Technologies, Inc.

Another group of suitable VD-AA materials is low-density granular materials that when coupled to structures for the purpose of reducing structural vibrations, provide a concomitant attenuation in airborne acoustic noises radiated from the structure. Such low-density granular materials including without limitation perlite; vermiculite; polyethylene beads; glass microspheres; expanded polystyrene; nylon flock; ceramics; polymeric elastomers; rubbers; dendritic particles; and mixtures thereof. Preferably, low-density granular materials with dendritic structures and low bulk sound speeds are used for VD-AA insert 36 to maximize damping of low-frequency vibrations and attenuating acoustic noises in club heads. Technology associated with the use of these low-density granular materials for damping structural vibrations is described by the trademark name Lodengraf™. Other low-density granular materials and their applications in various VD systems are described in U.S. Pat. Nos. 5,775,049, 5,820,348, 5,924,261, 6,224,341, and 6,237,302, the disclosures of which are incorporated herein by reference in their entirety.

Figure 6A:
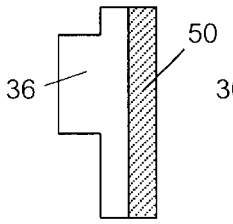
FIG. 6 is a cross sectional view of alternative layouts of the vibration damping and/or acoustic attenuating insert having a weight member therein.
Figure 6B:
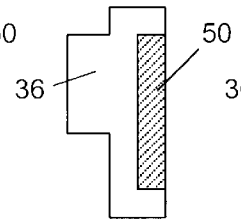
Figure 6C:
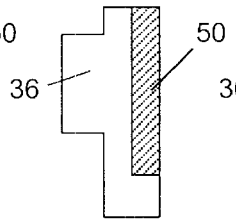
Figure 6D:
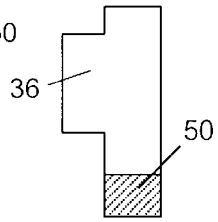
Figure 6E:
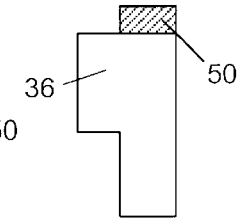
Figure 6F:
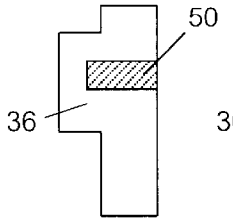
Figure 6G:
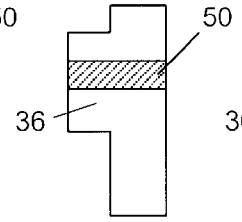
Figure 6H:
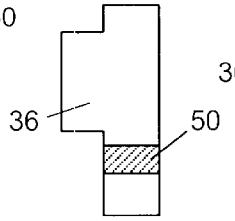
Figure 6I:
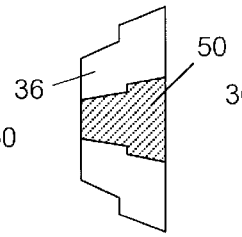
Figure 6J:
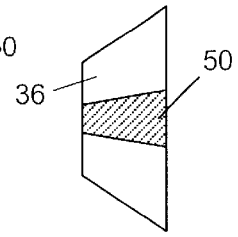

Alternatively, weight member 50 may be incorporated into VD-AA insert 36 to impart weight redistribution and shifting of centers of gravity in the club heads. FIG. 6 illustrates without limitation some examples of incorporating weight member 50 into VD-AA insert 36, including adjacent layouts like in FIGS. 6A, 6B, 6C, 6D and 6E, and embedded layouts like in FIGS. 6F, 6G, 6H, 6I and 6J. VD-AA insert 36 of FIGS. 6I and 6J may be preferred because the VD-AA material surrounding weight member 50 may be capable of making air-tight seal with captive insert cavity 32 and lower aperture 46, as shown in FIG. 3, resulting in best fit possible. In the case of FIG. 6J, similar seal and fit is also achieved between strike face insert 34 and VD-AA insert 36. To accommodate VD-AA insert 36 having a general shape of FIG. 61, conical-shaped captive insert cavity 32 and lower aperture 46 may be machined that gradually decrease in opening size from front side to rear side. For VD-AA insert 36 having a general shape of FIG. 6J, a conical-shaped lower aperture 46 may be sufficient to hold VD-AA insert 36 without fashioning captive insert cavity 32 and recessed rim 48. The skilled artisan will readily recognize that many different shock-absorbing materials and weighting compositions having many different sizes and shapes, including the ones shown in FIG. 6 and combinations thereof, may be substituted for VD-AA insert 36 without deviating from the scope of the invention.

To maximize its vibration damping and/or acoustic attenuating effects, VD-AA insert 36 may also comprise multiple layers of different VD-AA materials mentioned above. For acoustic attenuation purposes, VD-AA insert 36 may further comprise one or more acoustic attenuating materials such as ceramics and Helmholtz resonators.

Strike face insert 34 is preferably made from titanium although the skilled artisan will recognize that other suitable materials, having sufficient strength characteristics and a strength-to-weight ratio greater than that of the material of club head body, may be substituted without deviating from the scope of the invention. Some examples are graphite, Kevlar®, ceramics, beryllium alloys and the like. Strike face insert 34 is preferably coldworked into strike face insert cavity 26 and includes conventional grooves 38 on a front surface thereof. Undercuts 40 and 42 may be provided along the peripheral edge of strike face insert cavity 26 for holding strike face insert 34, as shown in FIG. 3.

In accordance with the present invention, it will be appreciated that various aspects of the invention, as well as combinations thereof provide a golf club with an improved manner of redistributing weight from central portions of the golf club to perimeter portions of the club head, thereby increasing the face area and the sweet spot without detrimentally altering overall weight or handling characteristics of the club. Apertures 30 and 46 eliminate material from a center portion of the head allowing weight redistribution toward the perimeter. Additionally, the volumes of shelf 44 and recessed rim 48 may be adjusted by varying their depths and widths to redistribute material from more central locations of the club head to more peripheral locations. Strike face insert cavity 26 may also be varied in depth, and strike face insert 34 may comprise a lighter material as explained above, thus allowing redistribution of excess weight.

The size of each of these features of the invention may be varied throughout a set of club heads, depending on the particular characteristics of the club head. In a preferred embodiment, the area of strike face insert 34 increases more gradually than with conventional club heads when moving from long to short irons while overall club weight remains essentially constant. Also, for example, for the long irons that are more difficult for the average golfer to consistently hit well, captive insert cavity 32 and lower aperture 46 may be enlarged allowing for a larger VD-AA insert 36 and redistribution of the excess weight about the perimeter of the strike face area. The use of larger VD-AA insert 36 provides more vibration damping for the longer irons where it tends to be needed the most.

In one embodiment, captive insert cavity 32 and lower aperture 46 are progressively smaller from the long clubs to the short clubs and different for each club. This embodiment allows for optimizing the weight distribution and strike face area for each club. However, manufacturing this embodiment requires a different tool for each club, thus potentially increasing production costs and manufacturing complexities. Therefore, in an alternative embodiment, a two step progression is used for the sizes of captive insert cavity 32 and lower aperture 46 to address such concerns while maintaining a sufficiently high degree of performance. In this alternative embodiment, a relatively shallow and small captive insert cavity 32 and a small lower aperture 46 may used on iron type club heads numbered six and higher, while a deep and large captive insert cavity 32 and a large lower aperture 46 may be used on iron type club heads numbered five and lower.

With respect to the volume of strike face insert cavity 26, captive insert cavity 32, and apertures 30 and 46, more incremental progression throughout the set of club heads may be used as well. Furthermore, materials and constructions of VD-AA insert 36 may be varied, such as by varying the material density thereof, to adjust the final club weight and vibration damping characteristics throughout the set of golf clubs. It will be appreciated that a progression of any number of steps, for example every other club rather than every club or only a single step, may be employed in a set of clubs.

In a further alternative embodiment, a universal configuration of club head body portion 12 having an identical captive insert cavity 32 and an identical lower aperture 46 may be used for each club in a set. VD-AA insert 36 having a lighter weight member 50 as depicted in FIG. 6, either by reducing its size or using a material having a lower density, is used in lower numbered long irons to provide more vibration damping while adding less weight back into the club heads. VD-AA insert 36 having a heavier weight insert 50, either by enlarging its size or using a material having a higher density, is used in higher numbered short irons to give more weight and sufficient vibration damping.

The aforementioned constructions of the club heads provide additional possibilities to adjust vertical positions of centers of gravity of the club heads, thereby enhancing their characteristics and performance. With reference to FIG. 3, vertical position D of center of gravity CG is the vertical distance between the center of gravity CG and a ground plane P superimposing lower edge 22 when club head 10 is oriented at the address position with grooves 38 parallel to ground plane P and axis B of hosel 14 contained in a plane perpendicular to ground plane P. In a conventional set of irons the vertical positions D of the centers of gravity CG gradually lowers moving from lower numbered clubs to higher numbered clubs. However, the reverse of this trend is desirable. That is, preferably, the vertical positions D of the centers of gravity CG generally rise or at least remain steady moving from lower-numbered long irons to higher-numbered short irons, and further to pitching wedges. Certain advantages are associated with this trend. Specifically, the lower center of gravity CG of the longer irons makes it easier for a golfer to get the ball airborne. The higher position of the center of gravity CG for the shorter irons reduces the likelihood of the shorter irons producing an overly high trajectory.

In accordance with the invention, there are several ways to achieve a trend of increasing vertical positions D of centers of gravity CG within a set a golf clubs. As mentioned above, the captive insert cavity 32, the upper aperture 30 and the lower aperture 46 may be reduced in size and lowered in vertical placement progressively throughout the set, leaving more material to the upper portion of the club head, thereby progressively elevating centers of gravity CG. When VD-AA insert 36 having a weight member 50 therein is employed, the vertical placement, the size, and the material density of the weight member 50 may increase progressively throughout the set of clubs to achieve elevated centers of gravity CG and associated advantages described above.

The present invention illustrates that VD-AA insert 36 is securely immobilized within the body portion 12 of the club head 10 by flanging tightly between recessed rim 48 and strike face insert 34 through direct contact. Alternatively, adhesives may be used on the contacting surfaces to ensure proper bonding of the components. The surfaces may also be mirror-polished to induce contact adhesion through molecular fusion between the contacting components to further strengthen the bonding.

The club head constructions described herein provide further advantages in incorporating markings and/or indicia composed of words and/or patterns onto the club heads. Specifically, indicia may be scribed onto the rear surface of VD-AA insert 36 as shown in FIGS. 1 and 5. Alternatively or in combination, indicia may also be scribed onto the rear surface of strike face insert 34. Methods of incorporating indicia and other types of markings include printing, etching, pressing, engraving, laminating, etc. Preferably, the indicia are scribed onto the components, including VD-AA 36 and strike face insert 34, prior to assembly of the club head. Simple shapes and flat surfaces of these components make the incorporation of indicia much easier than to scribe indicia directly onto the irregularly shaped and bulky club heads. Indicia may further be formed on upper edge 20 or other portions of club head exterior to visibly indicate the position of the internal VD-AA insert 36 to the golfer.

The term "about," as used herein in connection with one or more numbers or numerical ranges, should be understood to refer to all such numbers, including all numbers in a range.

As used herein, the term "shear modulus," also known as "rigidity modulus," of a vibration damping and/or acoustic attenuating material, is defined as a ratio of shear stress to shear strain, wherein the shear stress is the intensity of shear forces acting parallel or tangent to a plane of cut, and the shear strain is the angular deformation in circular measure. Shear modulus measures the resistance of a material to a change in shape, but not in volume, produced by a tangential stress. Shear modulus has the units of force per unit area.

As used herein, "loss factor" is defined as a ratio of the energy dissipated from a system to the energy stored in the system for every oscillation. The loss factor is used as a measure of a material's ability to damp structure-borne vibration and/or noise by stating how much vibration energy is converted to low-grad heat. The loss factor is commonly used to quantify the level of hysteretic damping of a material. The theoretical maximum loss factor is 1 (no vibration), and a loss factor of 0.1 is generally considered a minimum value for significant damping. Metals without vibration damping normally have a very low loss factor typically in a range of from about 0.001 to about 0.01.

Although the foregoing description of the preferred embodiments of the preferred invention have shown, described, and pointed out certain novel features of the invention, it will be understood that various omissions, modifications, substitutions, and changes in the form of the detail of the embodiments as illustrated as well as the uses thereof, may be made by those skilled in the art without departing from the spirit of the present invention. Consequently, the scope of the present invention should not be limited by the foregoing discussion, which is intended to illustrate rather than limit the scope of the invention.

What is claimed is:

1. A set of golf clubs, comprising a plurality of clubs wherein each of the plurality of clubs comprises a shaft and a club head, the shaft of each club being shorter in length than the shaft of a preceding club in the plurality of clubs, wherein:

each of the plurality of club heads has a front portion and a back portion;

the front portion defines a front cavity therein;

the back portion defines a back cavity therein;

the front cavity has a third cavity formed within;

the back cavity has an upper aperture therein communicating with the front cavity;

the back cavity has a lower aperture therein communicating with the third cavity; and a strike face insert is attached within the front cavity.

2. The set of golf clubs of claim 1, wherein a vertical position of a center of gravity of the club head progressively elevates for at least some clubs in the set.

3. The set of golf clubs of claim 1, wherein each of the plurality of club heads has a vibration dampening and acoustic attenuating member occupying the entire third cavity, the entire lower aperture and a portion of the back cavity.

4. The set of golf clubs of claim 3, wherein the upper aperture is surrounded by a shelf having a first volume of material, and wherein the first volume of material progressively increases for at least some clubs in the set.

5. The set of golf clubs of claim 3, wherein the lower aperture is surrounded by a rim having a second volume of material, and wherein the second volume of material progressively increases for at least some clubs in the set.

6. The set of golf clubs of claim 3, wherein a volume of the upper aperture progressively decreases for at least some clubs in the set.

7. The set of golf clubs of claim 3, wherein a volume of the third cavity progressively decreases for at least some clubs in the set.

8. The set of golf clubs of claim 3, wherein a volume of the lower aperture progressively decreases for at least some clubs in the set.

* * * * *